US007044814B2

(12) United States Patent
Kamio et al.

(10) Patent No.: US 7,044,814 B2
(45) Date of Patent: May 16, 2006

(54) MAIN SWITCH APPARATUS OF SMALL WATERCRAFT

(75) Inventors: Kunihiko Kamio, Kobe (JP); Atsufumi Ozaki, Kobe (JP); Keiji Takahashi, Akashi (JP); Toshio Araki, Kobe (JP); Satoru Watabe, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/060,639

(22) Filed: Feb. 16, 2005

(65) Prior Publication Data

US 2005/0181685 A1 Aug. 18, 2005

(30) Foreign Application Priority Data

Feb. 17, 2004 (JP) ..... 2004-040314

(51) Int. Cl.
*B63H 21/22* (2006.01)

(52) U.S. Cl. ..... 440/1; 340/5.65; 701/115

(58) Field of Classification Search ..... 440/1; 701/110, 115; 340/5.65, 5.67, 426.13, 426.35
See application file for complete search history.

(56) References Cited

U.S. PATENT DOCUMENTS 3,660,624 A * 5/1972 Bell ..... 200/43.05
4,438,426 A * 3/1984 Adkins ..... 340/5.65
4,868,559 A * 9/1989 Pinnow ..... 340/5.67
4,993,627 A * 2/1991 Phelan et al. ..... 340/5.67
5,610,574 A * 3/1997 Mutoh et al. ..... 340/426.35
5,818,330 A * 10/1998 Schweiger ..... 340/426.13
5,988,130 A * 11/1999 Nakamura ..... 123/179.5
6,772,061 B1 * 8/2004 Berthiaume et al. ..... 701/110

FOREIGN PATENT DOCUMENTS

JP 2988835 B 4/1996

* cited by examiner

*Primary Examiner*—Lars A. Olson
(74) *Attorney, Agent, or Firm*—Alleman Hall McCoy Russell & Tuttle LLP

(57) ABSTRACT

A main switch apparatus of a small watercraft is provided. The main switch apparatus of a small watercraft having a main switch. The main switch apparatus includes a plurality of keys, each for operating the main switch, each assigned a different user ID information. The main switch apparatus may further include an ID information detector for detecting the user ID information assigned to one of the plurality of keys applied to the main switch, a controller for controlling the small watercraft, configured to be activated by each one of the plurality of keys, and a control pattern memory for storing a plurality of control patterns of the controller corresponding to the respective user ID information. The controller is typically configured to read out the control pattern stored in the control pattern memory corresponding to the user ID information detected by the user ID information detector and to execute a control of the watercraft based on the read out control pattern.

9 Claims, 9 Drawing Sheets

MAIN SWITCH APPARATUS OF SMALL WATERCRAFT

TECHNICAL FIELD

The present invention relates to a main switch apparatus of a small watercraft, and more particularly, to a main switch apparatus capable of easily changing operational settings of the small watercraft depending on each user.

BACKGROUND OF THE INVENTION

For example, when one small watercraft is used by two or more users, desirable power characteristics and power levels may differ for each user. Therefore, some users may desire to have a different engine tuning (i.e., different operational settings) for the small watercraft, from other users (see for example Japanese Patent No. 2988835).

BRIEF SUMMARY OF THE INVENTION

The present invention provides a main switch apparatus of a small watercraft having a key-type main switch similar to that of an automobile, which is capable of changing an operational setting depending on a key recognized by the main switch.

The main switch apparatus of a small watercraft having a main switch typically includes a plurality of keys, each for operating the main switch, and each being assigned a different user ID information. The main switch apparatus further typically includes an ID information detector for detecting the user ID information assigned to one of the plurality of keys applied to the main switch, a controller for controlling the small watercraft, configured to be activated by each one of the plurality of keys; and a control pattern memory for storing a plurality of control patterns of the controller corresponding to the respective user ID information, wherein the controller is configured to read out the control pattern stored in the control pattern memory corresponding to the user ID information detected by the user ID information detector and to execute a control of the watercraft based on the read out control pattern.

The main switch apparatus selectively changes the control pattern of the controller which controls various parts of the small watercraft based on the user ID information assigned to each key which is configured to operate the main switch. A plurality of the control patterns corresponding to each key (each key typically contains a unique user ID information) are stored in an appropriate storage device which is controllably available for the controller. Therefore, for example, by each user merely carrying the key having the user ID information and applying the key to the main switch, each user can operate the small watercraft with a suitable operational setting (including a tuning setting etc.) for the user.

As described herein, the controller may be set in an active state, which is not limited to a state in which the controller can perform all functions thereof. Rather, the active state may be a state of the controller driven with a standby electric power supply. The ID information detector may be configured to detect or extract the user ID information from the key. More particularly, the ID information detector may be a general sensor or receiver which communicatively receives the user ID information from the key.

In order to change the operational setting, it may be only required to change the control parameter of the controller (for example, an ECU or Electronic Control Unit of the watercraft). As the control parameter, any suitable control parameter of the controller may be used. For example, at least one of control variables of an ignition device of an engine and a fuel injection device may be used. It is also possible to use display information (for example, which setting is chosen) of an indicator, and a steering angle of a steering device of the watercraft, etc.

In addition to the user individual operational setting selecting function as described above, it is also possible to combine a user individual theft prevention function using the key-type main switch.

The above and further objects and features of the present invention will more fully be apparent from the following detailed description with accompanying drawings.

DETAILED DESCRIPTION OF THE INVENTION

The present invention will now be described in detail referring to the accompanying drawings illustrating the embodiments thereof.

Figure 1:
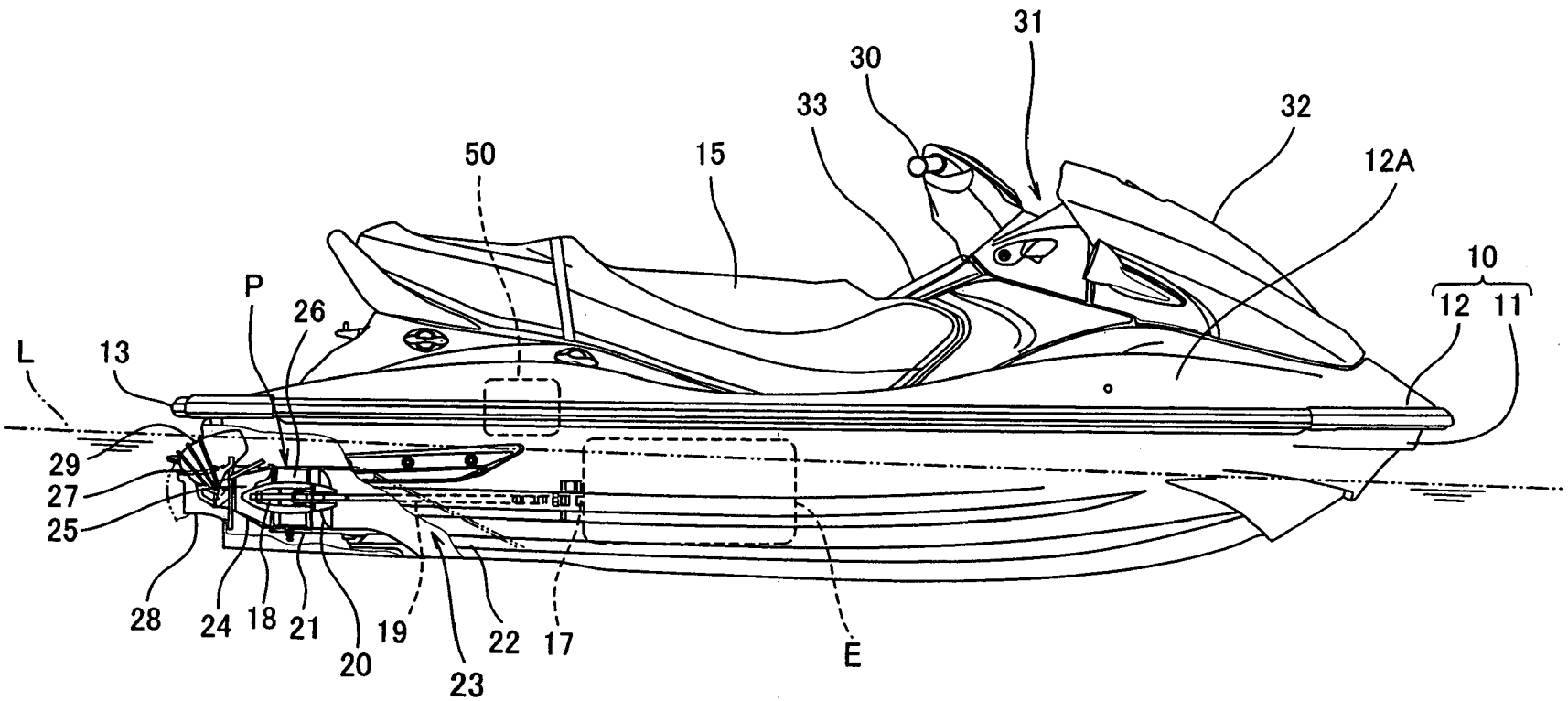
FIG. 1 is a side view of an entire small watercraft according to an embodiment of the present invention.
Figure 2:
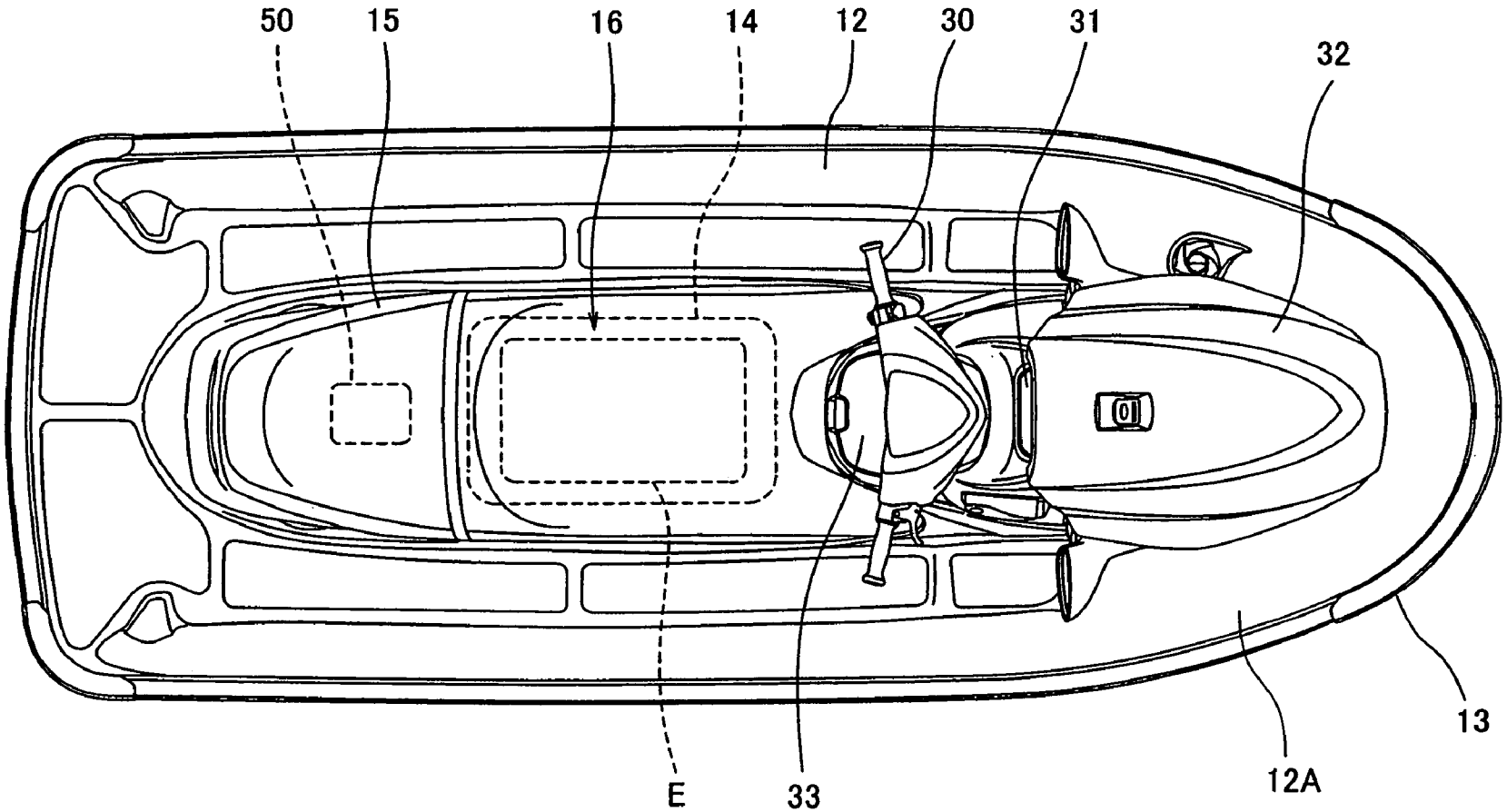
FIG. 2 is a plan view of the small watercraft shown in FIG. 1.

FIG. 1 is a side view showing an entire small watercraft of an embodiment according to the present invention, and FIG. 2 is a plan view of the small watercraft shown in FIG. 1. In FIGS. 1 and 2, a body 10 of the small watercraft includes a hull 11 and a deck 12 covering the hull 11 from above. The hull 11 and the deck 12 are connected to each other at a gunnel line 13 which extends over the entire perimeter of the hull 11 and the deck 12. In this embodiment, the gunnel line 13 is normally located above a waterline L (which is shown in a two-dot dashed line in FIG. 1) of the small watercraft in the stationary condition.

As shown with a dashed line in FIG. 2, an opening 14 of substantially rectangular shape extending in the longitudinal direction of the watercraft is formed slightly rear of the middle section of the deck 12. The opening 14 is covered from above by a seat 15 on which an operator straddles. An engine E is provided in a space (usually referred to as "an engine room") 16 surrounded by the hull 11 and the deck 12 below the seat 15.

As shown in FIG. 1, a crankshaft 17 of the engine E extends rearward, and a rear end portion of the crankshaft 17 is rotatably coupled integrally with a pump shaft 18 of a water jet pump P through a propeller shaft 19. An impeller 20 is attached on the pump shaft 18 of the water jet pump P. The impeller 20 is covered with a cylindrical pump casing 21 on the outer periphery thereof.

A water intake 22 is provided on the bottom of the hull 11. Water is sucked from the water intake 22 and fed to the water jet pump P through a water intake passage 23. The water jet pump P pressurizes and accelerates the water by rotation of the impeller 20. The pressurized and accelerated water is discharged through a pump nozzle 24 having a cross-sectional area of water flow gradually reduced rearward, and from an outlet port 25 provided on the rear end portion of the pump nozzle 24, thereby obtaining a thrust. In FIG. 1, a reference numeral 26 denotes fairing vanes for smoothing water flow behind the impeller 20.

As shown in FIGS. 1 and 2, a reference numeral 30 denotes a bar-type steering handle. The steering handle 30 operates in association with a steering nozzle 28 swingable around a swing shaft (not shown) to the right or to the left behind the pump nozzle 24. When the operator rotates the steering handle 30 clockwise (to the right) or counterclockwise (to the left), the steering nozzle 28 is swung toward the opposite direction so that the watercraft can be correspondingly turned to a desired direction.

As shown in FIG. 1, a bowl-shaped reverse deflector 29 is provided above the rear section of the steering nozzle 28 such that it can swing downward around a horizontally mounted swinging shaft 27. Thereby, the deflector 29 is swung to a lower position behind the steering nozzle 28 and the water discharged rearward from the steering nozzle 28 is deflected forward. Thus, switching of watercraft travel direction from forward to rearward can be performed.

In FIGS. 1 and 2, a multi-function meter 31 is provided in a front deck portion 12A in front of the steering handle 30. Further in the front deck portion 12A in front of the multi-function meter 31, a front hatch cover 32 is provided, extended from a front end portion proximity to a bow of the watercraft to the multi-function meter 31. The multi-function meter 31 is configured to display various information, such as a traveling speed, remaining amount of fuel, etc., of the watercraft.

The front hatch cover 32 is configured to be pivotable about an axis (not shown) in the left-and-right direction at a front end thereof. Opening and closing operation of the front hatch cover 32 about the axis is assisted by a spring-damper mechanism (not shown). The rear end portion of the hatch cover 32 extends slightly over the multi-function meter 31 so as to serve as a sunshade for the multi-function meter 31.

Figure 3:
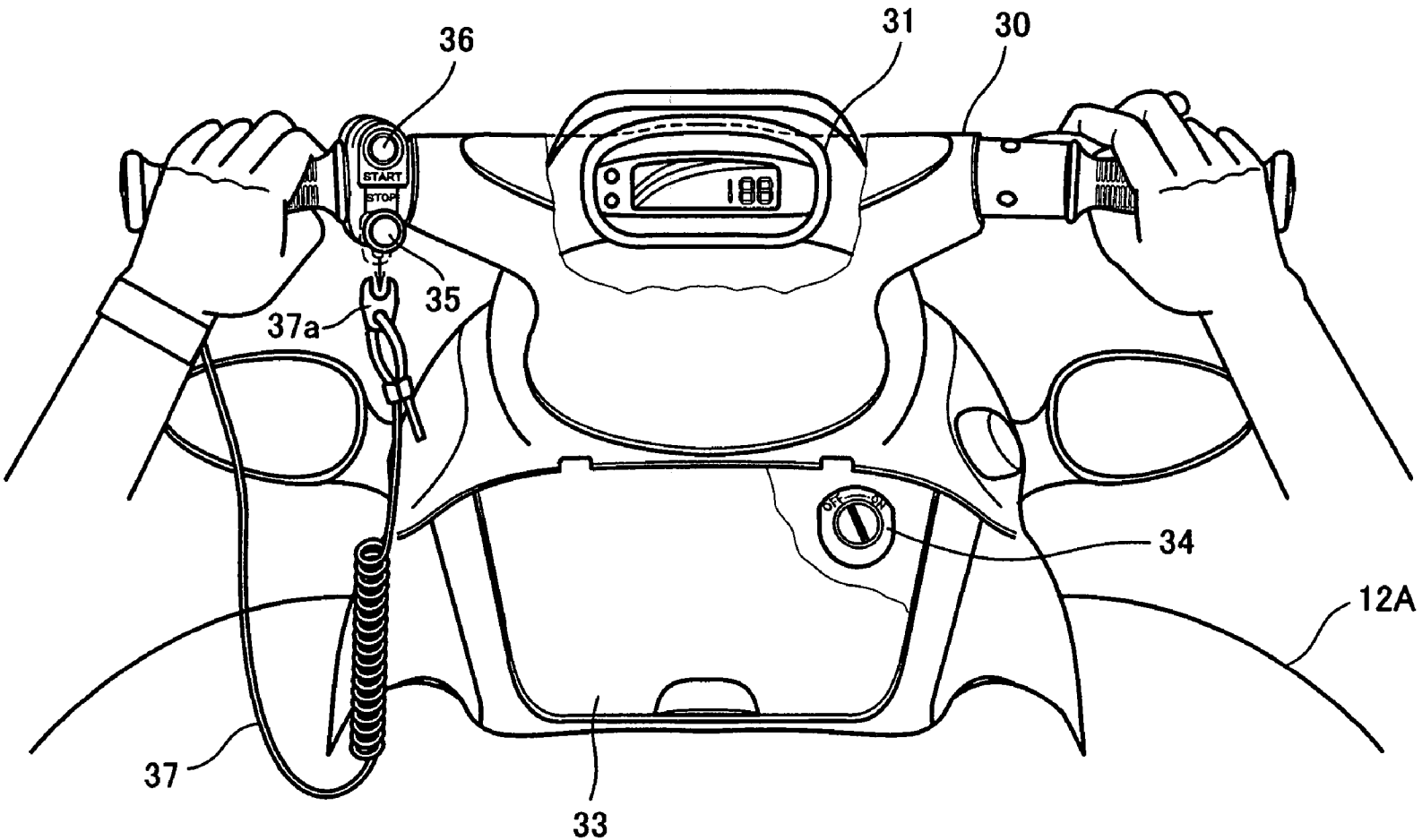
FIG. 3 is a schematic view showing a configuration proximity to the steering handle of the small watercraft shown in FIG. 1.

Moreover, the glove box (not shown) of a small capacity is provided between the steering handle 30 and the sheet 15, and the glove box is covered by a glove box cover 33 with a main switch 34 provided adjacently the glove box, as shown in FIG. 3. In FIG. 3, a part of the glove box cover 33 is shown cutaway so that the main switch 34 inside thereof can be seen.

Figure 4:
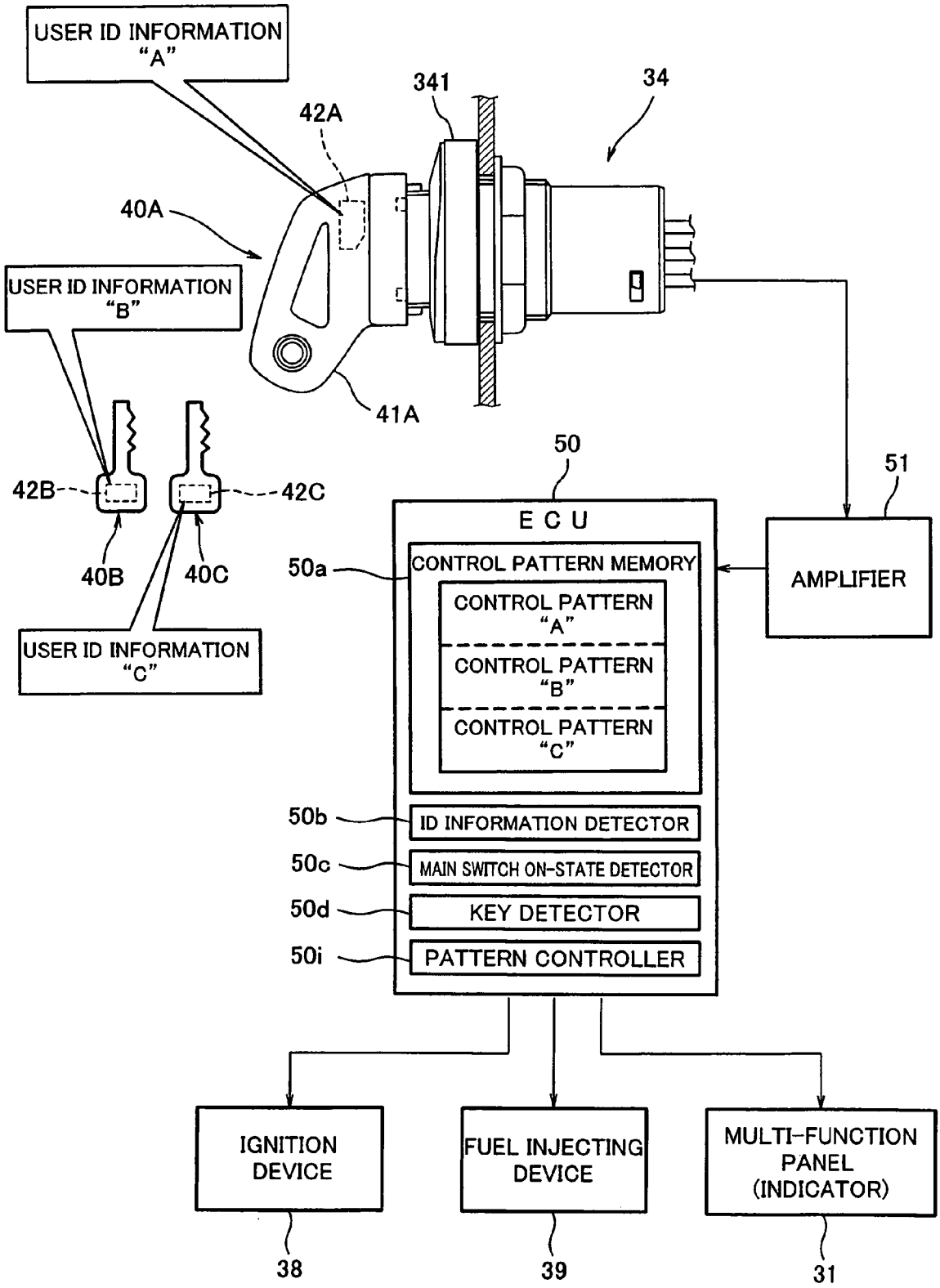
FIG. 4 is a block diagram showing a configuration of a main switch apparatus equipped by the small watercraft shown in FIG. 1.

As shown in FIG. 4, the main switch 34 is configured so that any one of the keys 40A, 40B, and 40C may be inserted therein and, then rotated to one direction (clockwise in this embodiment) to transition the main switch 34 to an ON-state/ON-position and to the other direction (counterclockwise in this embodiment) to transition the main switch 34 in an OFF-state/OFF-position, similar to a main switch of an automobile (also see FIG. 3). However, the main switch 34 is different from the main switch of an automobile in that the key can be removed from the main switch 34 even in the ON-state. In FIG. 4, three keys 40A, 40B, and 40C are shown as keys which can be used to operate ON/OFF of the main switch 34. Each key stores typically unique and individual user ID information therein as described hereinafter. The number of keys is not intended to be limited to three, and thus two, four, or more keys may be provided depending on the number of the users.

By way of example, key 40A includes a transponder 42A in a handle portion 41A (typically, formed from a plastic material, etc.) thereof. Similarly, the key 40B includes a transponder 42B therein and the key 40C includes a transponder 42C therein. The transponder of each key stores the individual user ID information for an individual key and/or user. Since the configuration of each key typically is the same except for the user ID information in this embodiment, the keys will be described below with general reference to a key 40.

Key 40 may be inserted in the main switch 34 and rotated to an ON-position in which the main switch 34 is in the ON-state. Then, electric power typically is supplied from the main switch 34 through a tip portion (not shown) of the key 40 to the transponder 42. In this embodiment, the tip portion is made of an electrically conducting material. In accordance with the electric power supply, the transponder 42 carries out a radio transmission of the stored user ID information.

On the other hand, the main switch 34 includes an antenna 341 of typically a ring shape at a portion which is adjacent the key 40 inserted therein. The antenna 341 receives the user ID information transmitted from the transponder 42 and, then, sends the received user ID information to the amplifier 51 connected to the main switch 34. The amplifier 51 amplifies the given user ID information which consists of an analog signal and, then, converts the analog user ID information into a digital signal and, then, gives the digital user ID information to an ECU (Electronic Control Unit) 50 connected to the amplifier 51.

Although the user ID information stored in the key 40 is given to ECU 50 by the radio communications using the transponder 42 in the embodiment, it is also possible to use other radio-communication devices, such as a reader/writer, an optical communication device. It is also possible to use cable communications. In this embodiment, although the amplifier 51 is provided, it may not be needed if the user ID information received by the antenna 341 can be converted into a usable form for ECU 50.

ECU 50 is disposed in the small watercraft as shown in FIGS. 1 and 2. As shown in FIG. 4, ECU 50 includes a control pattern memory 50*a*, an ID information detector 50*b*, a main switch ON-state detector 50*c*, a key detector 50*d*, and pattern controller 50*i*. In FIG. 4, ECU 50 is shown as connected to an ignition device 38 and a fuel injection device 39 of the engine E as controlled objects, for example. The controlled object of ECU 50 may include the multi-function panel 31 as also shown in FIG. 4. The controlled object is not intended to be limited only to those disclosed but may also include other suitable objects which are controllable by ECU 50.

The ignition device 38 may include an ignition coil (not shown) of the engine E. The ignition device 38 supplies electric power to a corresponding spark plug (not shown) in accordance with an ignition signal from ECU 50 and, then, it ignites fuel within an engine cylinder at a suitable timing.

The fuel injection device 39 may include a fuel injector (not shown) of the engine E. The fuel injection device 39 supplies electric power to the corresponding fuel injector in accordance with an injection signal from ECU 50 and, then, it performs a fuel injection of a suitable quantity of fuel, and at a suitable timing.

The control pattern memory 50*a* of ECU 50 stores a plurality of user ID information corresponding to the user ID information stored in each key 40 and the control patterns (in FIG. 4, the control patterns are indicated as "A", "B", and "C", respectively corresponding to the user ID information for each key 40) of ECU 50 corresponding to each user ID information. Each control pattern may include one control parameter or a combination of two or more control parameters. Some examples of the control parameters are an ignition timing of the ignition device 38 of the engine E, an amount and/or timing of fuel injection of the fuel injection device 39 of the engine E, and/or a display or an output pattern of the multi-function panel (indicator) 31.

ECU 50 reads out the control pattern from the memory 50*a* in accordance with the received user ID information and, then, performs a control of various parts of the watercraft based on the control pattern. That is, by setting the control pattern in accordance with preferences and restrictions of a particular user who uses the key 40, it is possible to realize operability and tuning, that is, an operational setting of the watercraft, based on the user. Next, a control routine of ECU 50 is explained in more detail referring to a flowchart shown in FIG. 5.

Figure 5:
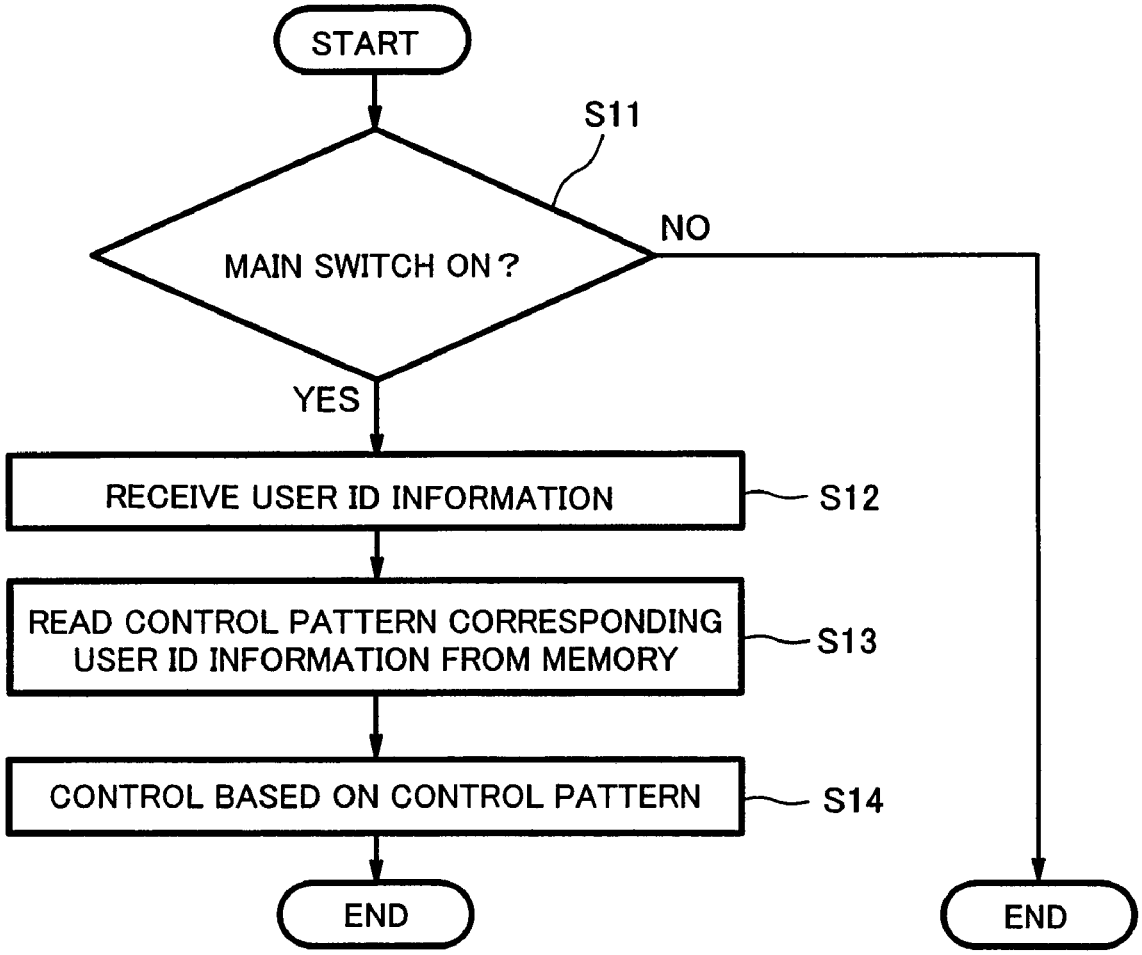
FIG. 5 is a flowchart showing a control procedure of an ECU (Electronic Control Unit) of the main switch apparatus shown in FIG. 4.

As shown in FIG. 5, first, ECU 50 determines by the main switch ON-state detector 50*c* if the main switch 34 is in the ON-state (Step S11). If the main switch 34 is not in the ON-state ("NO" at Step S11), this routine is terminated.

On the other hand, if the main switch 34 is in the ON-state ("YES" at Step S11), ECU 50 receives by the ID information detector 50*b* the user ID information given from the key 40 through amplifier 51 (Step S12). Furthermore, ECU 50 reads the control pattern corresponding to the received user ID information from the control pattern memory 50*a* (Step S13), and controls the controlled objects (for example, the ignition device 38, the fuel injection device 39, the multi-function panel 31, etc.) specified in the control pattern based on the read control pattern (Step S14).

Herein, a state in which one of the keys 40 is inserted in the main switch 34 has been described, however, ECU 50 may be configured so that, once after ECU 50 recognizes the user based on the key 40 inserted in the main switch 34, ECU 50 continues the user individual control even if the key 40 is removed from the main switch 34 while the main switch 34 is in the ON-state.

In addition to the above function, the user individual control pattern is also possible to utilize as a user individual theft prevention function as explained below.

For example, referring again to FIG. 3, a starter switch 36 connected to ECU 50 is disposed in one side portion of the steering handle 30 (in the embodiment, left-hand side). A kill switch 35 which kills the engine E is disposed adjacent the starter switch 36. The starter switch 36 typically is a pushbutton-type switch. When a user pushes the starter switch 36, electric power is supplied to a starter motor M (see FIG. 6) of the engine E and, then, the engine E starts. The kill switch 35 typically is a pushbutton-type switch, in the same form as the starter switch 36. When the user pushes the kill switch 35, an electric power supply to the ignition device 38, the fuel-injection device 39, etc. (see FIG. 6) of the engine E is stopped and, then, the engine E stops. The kill switch 35 typically is equipped with a tether cord 37. The tether cord 37 is attached around the user's wrist (in FIG. 3, user's left wrist) at one end thereof. The other end of the tether cord 37 is provided with a clip portion 37*a*. The starter switch 36 is typically able to be operated when the clip portion 37*a* of the tether cord 37 is attached to the kill switch 35 and the main switch 34 is turned to the ON-position after the key 40 (see FIG. 4) is inserted into the main switch 34. Typically, the pushbutton-type kill switch 35 is only functional when the clip 37*a* is attached thereto.

Figure 6:
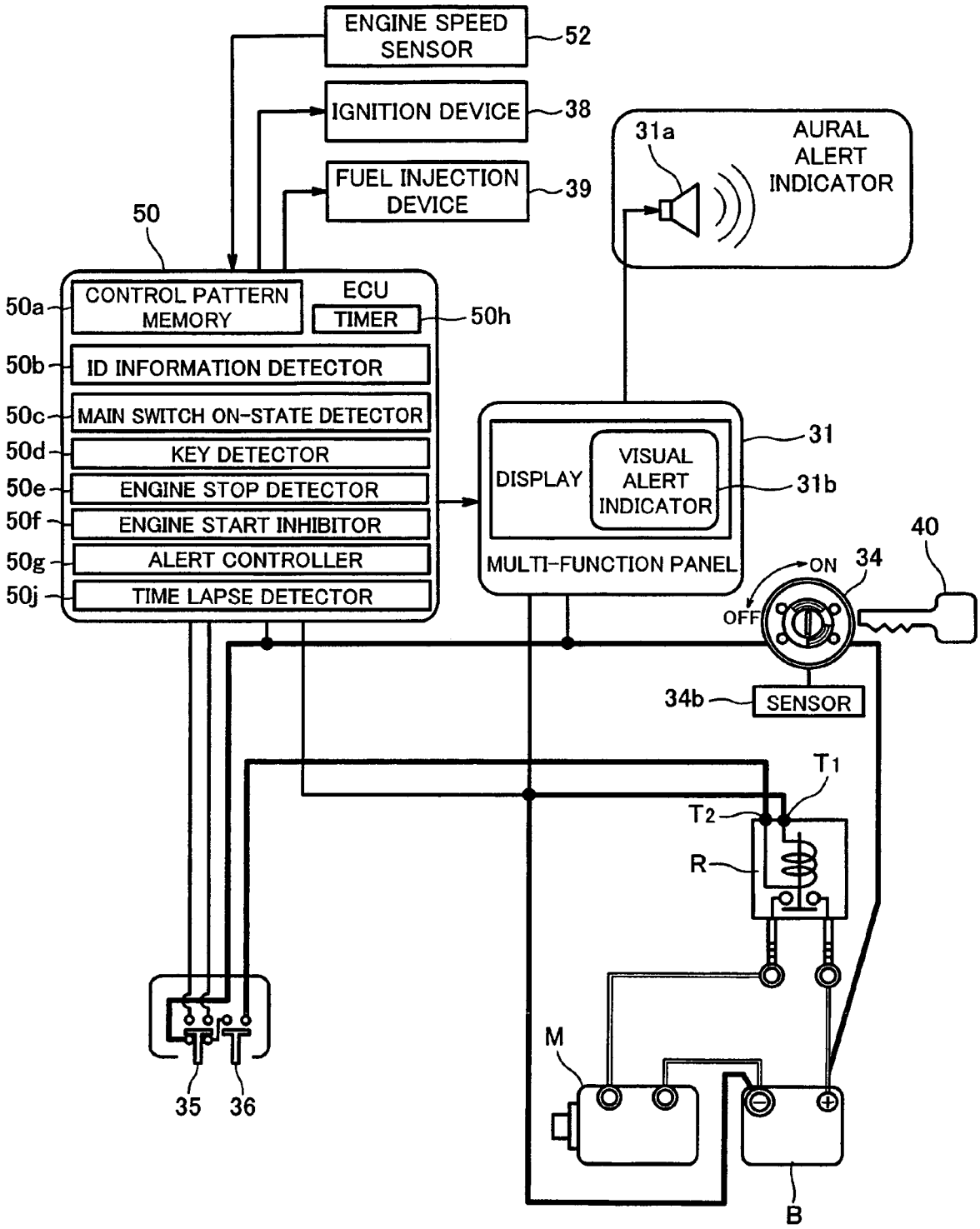
FIG. 6 is a block diagram showing another configuration of the main switch apparatus equipped by the small watercraft shown in FIG. 1.

FIG. 6 mainly shows a circuit diagram to realize the individual user theft prevention function, and it is also possible to utilize the configuration of the circuit diagram in combination with the configuration already shown in FIG. 4. In FIG. 6, a battery B and the starter motor M are connected in series through a normally-open contact of a starter relay R and, thus, a drive circuit (shown with a double line) of the starter motor M is established.

One terminal T1 (on the coil portion side) of the starter relay R is connected to a minus terminal of the battery B. The other terminal T2 (on the coil portion side) of the starter relay R is connected to one terminal of the starter switch 36 which typically is a normally-open type pushbutton switch. The other terminal of the starter switch 36 is connected to one terminal of the kill switch 35 which typically is a two-point-of-contact pushbutton switch of normally-closed type (as mentioned above, the switch becomes normally-closed by attaching the clip 37*a* of the tether cord 37). The other terminal of the kill switch 35 is connected to a plus terminal of the battery B through the main switch 34 and, thus, a relay operating circuit (shown with a thick line) of the motor M is established.

Therefore, in a state that the clip 37*a* of the tether cord 37 is attached to the kill switch 35, the key 40 is inserted into the main switch 34 in the OFF-position, the main switch 34 is rotated clockwise to the ON-position, and then the starter switch 36 is pushed. Thus, electric power is supplied to the relay operating circuit, the coil portion of the starter relay R is excited, and the normally-open contact of the starter relay R is closed. Accordingly, electric power is supplied to the drive circuit and, thereby, the engine E is cranked as the starter motor M operates.

The ECU 50 and the multi-function panel 31 are connected to the plus terminal of the battery B through the main switch 34 at one of the power line terminals thereof. Another of the power line terminals is connected to the minus terminal of the battery B. Thereby, electric power is supplied to the main switch 34 in the ON-position.

The contacts of the kill switch 35 on the OFF side are connected to ECU 50. ECU 50 is configured to detect electric power supply by connecting of the contacts of the kill switch 35 on the OFF side (that is, a stop operation of the engine E).

ECU 50 typically includes the control pattern memory 50*a*, the ID information detector 50*b*, the main switch ON-state detector 50*c*, and the key detector 50*d*. ECU 50 also includes an engine stop detector 50*e*, an engine start inhibitor 50*f*, an alert controller 50*g*, a timer 50*h*, and a time lapse detector 50*j*. As mentioned above, ECU 50 is connected with the multi-function panel 31, the ignition device 38, and the fuel injection device 39, as well as with an engine speed sensor 52, by signal lines. Typically, the engine speed sensor 52 is a rotary encoder which typically is attached to an end of the crankshaft 17 (see FIG. 1) or a flywheel (not illustrated) of the engine E. The engine speed sensor 52 transmits a detection signal corresponding to the engine speed to ECU 50. The output of the ignition signal and the injection signal from ECU 50 is started with the above-mentioned cranking of the engine E in accordance with pushing of the starter switch 36.

ECU 50 recognizes the stop of the engine E by the detection signal from the engine speed sensor 52, or the detection of electric power supply to the kill switch 35 by the engine stop operation of the kill switch 35. As ECU 50 recognizes the engine stop, ECU 50 controls the multi-function panel 31, the ignition device 38, and the fuel injection device 39 as explained hereinafter referring to a flowchart shown in FIG. 7. ECU 50 stores a plurality of control patterns in the control pattern memory 50*a* so as to realize the user individual theft prevention function corresponding to each user ID information.

Prior to the following control routine of ECU 50, once any one of the keys 40 is inserted in the main switch 34, the main switch 34 is rotated to the ON-position and, thus, the engine E starts. Once this condition is established, ECU 50 receives the user ID information from the key 40 by the ID information detector 50*b*and stores the user ID information in the control pattern memory 50*a*.

Figure 7:
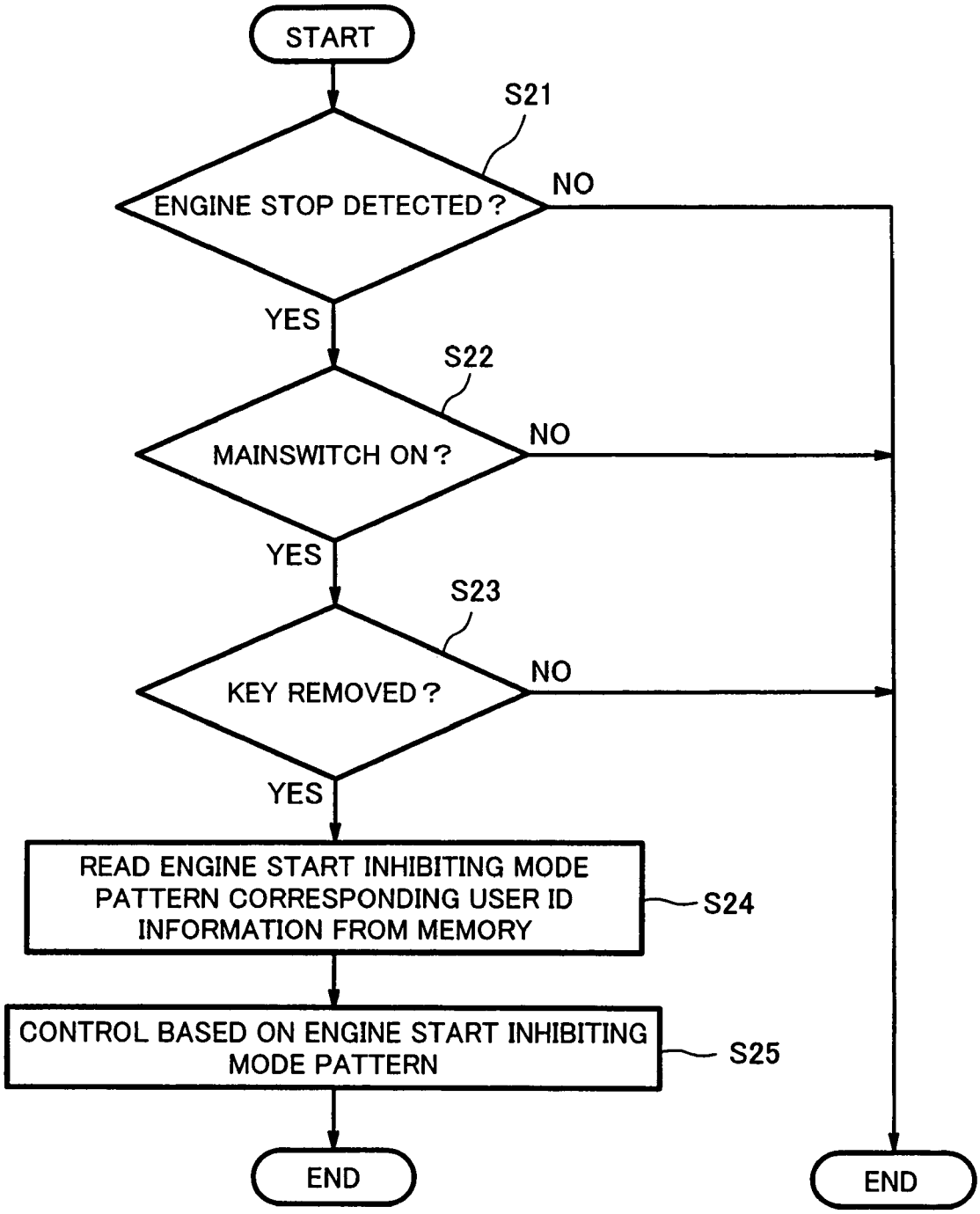
FIG. 7 is a flowchart showing a control procedure of an ECU (Electronic Control Unit) of the main switch apparatus shown in FIG. 6.

As shown in FIG. 7, ECU 50 determines if the stop of the engine E is detected by the engine stop detector 50*e* (Step S21). The engine stop may be detected, for example, by detecting zero or approximately zero engine speed based on the detection signal from the engine speed sensor 52 or by detecting electric power supply to the kill switch 35 by the engine stop operation of the kill switch 35. If the engine stop is not detected ("NO" at Step S21), ECU 50 terminates this routine.

On the other hand, if the engine stop is detected ("YES" at Step S21), ECU 50 determines by the main switch ON-state detector 50*c* if the main switch 34 is in the ON-position (Step S22). The determination that the main switch 34 is in the ON-position may be performed by detecting of presence of the electric power supply to the main switch 34. Here, in the state in which electric power is supplied to ECU 50 from the battery B, the main switch 34 should be in the ON-position. Alternatively, the determination may be performed by detecting electric power supply to a certain switch or a detection signal from a sensor. The switch or sensor 34*b* may be provided to the ON-position of the main switch 34.

If the main switch 34 is not in the ON-position, that is, it is in the OFF-position ("NO" at Step S22), this routine is terminated since electric power is not supplied to ECU 50. On the other hand, if the main switch 34 is in the ON-position ("YES" at Step S22), ECU 50 then determines by the key detector 50*d* if the key 40 (which was inserted in the main switch 34) is removed from the main switch 34 (Step S23). If the key 40 is inserted in the main switch 34 ("NO" at Step S23), ECU 50 ends this routine to alternatively perform a normal routine other than this routine.

On the other hand, if the key 40 is removed from the main switch 34 ("YES" at Step S23), ECU 50 reads the control pattern for realizing the theft prevention-function corresponding to the received user ID information from the control pattern memory 50*a* (Step S24). Then, ECU 50 transitions the engine start inhibitor 50*f* to an "Engine Start Inhibiting Mode" based on the read control pattern (an engine start inhibiting mode pattern) (Step S25). The Engine Start Inhibiting Mode is configured to inhibit start of the engine E even if the starter switch 36 is operated. This may be achieved by ECU 50 not outputting the ignition signal to the ignition device 38 or not outputting the injection signal to the fuel injection device 39, etc.

In the Engine Start Inhibiting Mode, ECU 50 may control so as to produce an output by the alert controller 50*g* indicating that ECU 50 is in the "Engine Start Inhibiting Mode" on the multi-function panel 31. The user individual theft prevention function may be to output, for example, an aural output corresponding to the user from an aural alert indicator 31*a* (see FIG. 6) with which the multi-function panel 31 is equipped, and/or a visual output from a specific visual alert indicator 31*b* of a display portion (see FIG. 6) with which the multi-function panel 31 is equipped.

Although not illustrated in FIG. 6, it is also possible to connect an appropriate contact in series with the drive circuit of the starter motor M and to open the contact by ECU 50 to inhibit electric power supply to the drive circuit.

Typically, the Engine Start Inhibiting Mode is terminated by inserting one of the keys 40 in the main switch 34 and turning the main switch 34 into the OFF-position during the Engine Start Inhibiting Mode and, thereby stopping electric power supply to ECU 50. Of course, it is also possible to configure so that such a termination operation cannot be performed with another key 40 which is not used to transit to the Engine Start Inhibiting Mode.

Figure 8:
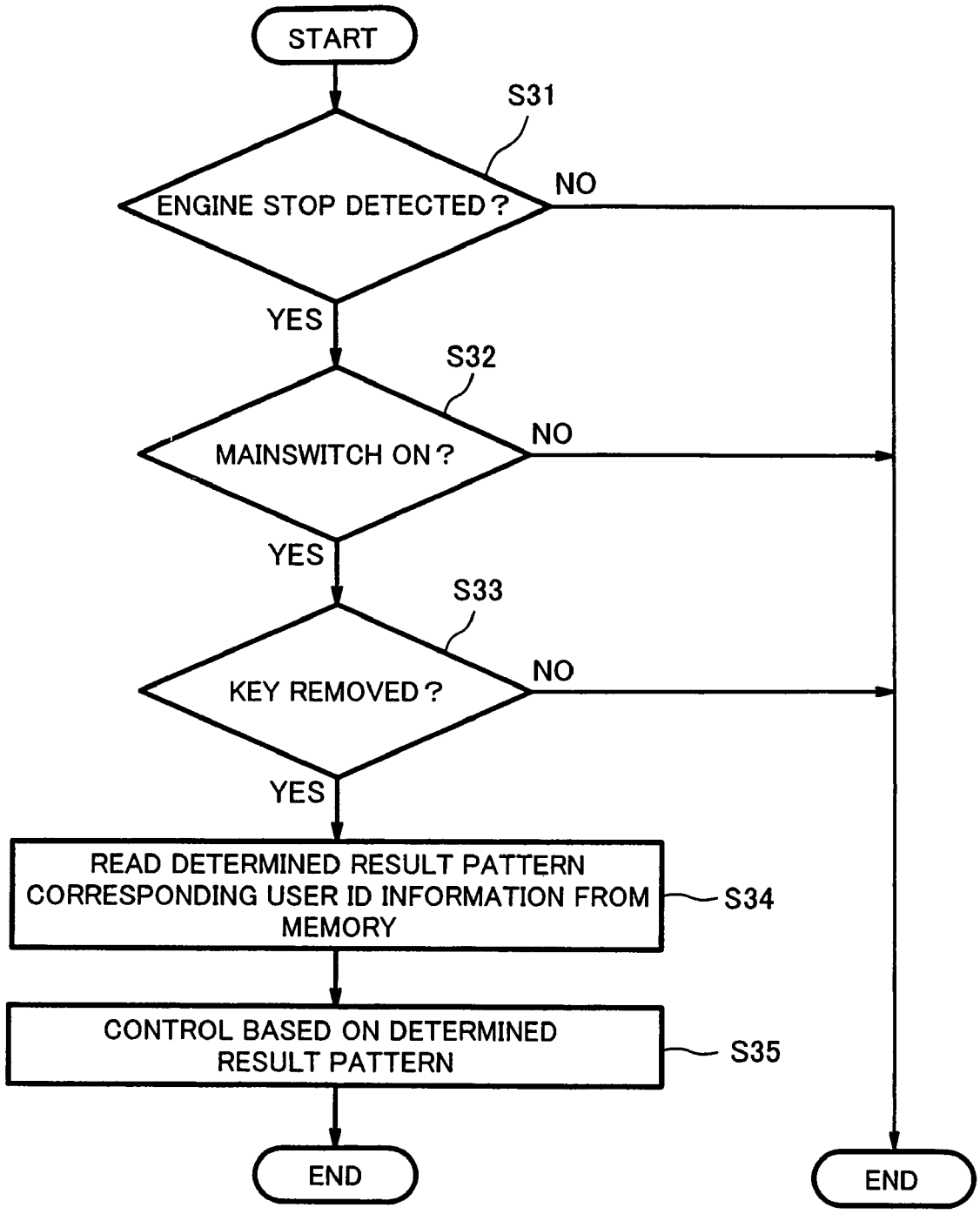
FIG. 8 is a flowchart showing another control procedure of the ECU of the main switch apparatus shown in FIG. 6.

In another embodiment shown in FIG. 8, ECU 50 does not transition to the Engine Start Inhibiting Mode even if it recognizes/determines a removal of the key 40 from the main switch 34 in the ON-state. Alternatively, the ECU 50 controls to output information to the multi-function panel 31 corresponding to the determined result, such as the engine stop, the main switch ON, and the removal of the key (a Determined Result Output Routine). In order to warn the proper user that anyone can restart the engine E by merely operating the starter switch 36 from the state in which the key 40 is removed from the main switch 34 in the ON-state, the information corresponding to the determined result may be outputted by supplying electric power to the aural alert indicator 31*a* (see FIG. 6) of the multi-function panel 31, blinking of an illuminant of the visual alert indicator 31*b* of the multi-function panel 31 (for example, blinking the entire multi-function panel of an entirely illuminating type), etc. Steps S31–S35 in FIG. 8 are arranged such that the transition steps to the "Engine Start Inhibiting Mode" (S24–S25) in FIG. 7 are merely replaced with the Determined Result Output Routine (S34–S35). Since the other steps in FIG. 8 are similar to those in FIG. 7, explanation of these steps is omitted.

Figure 9:
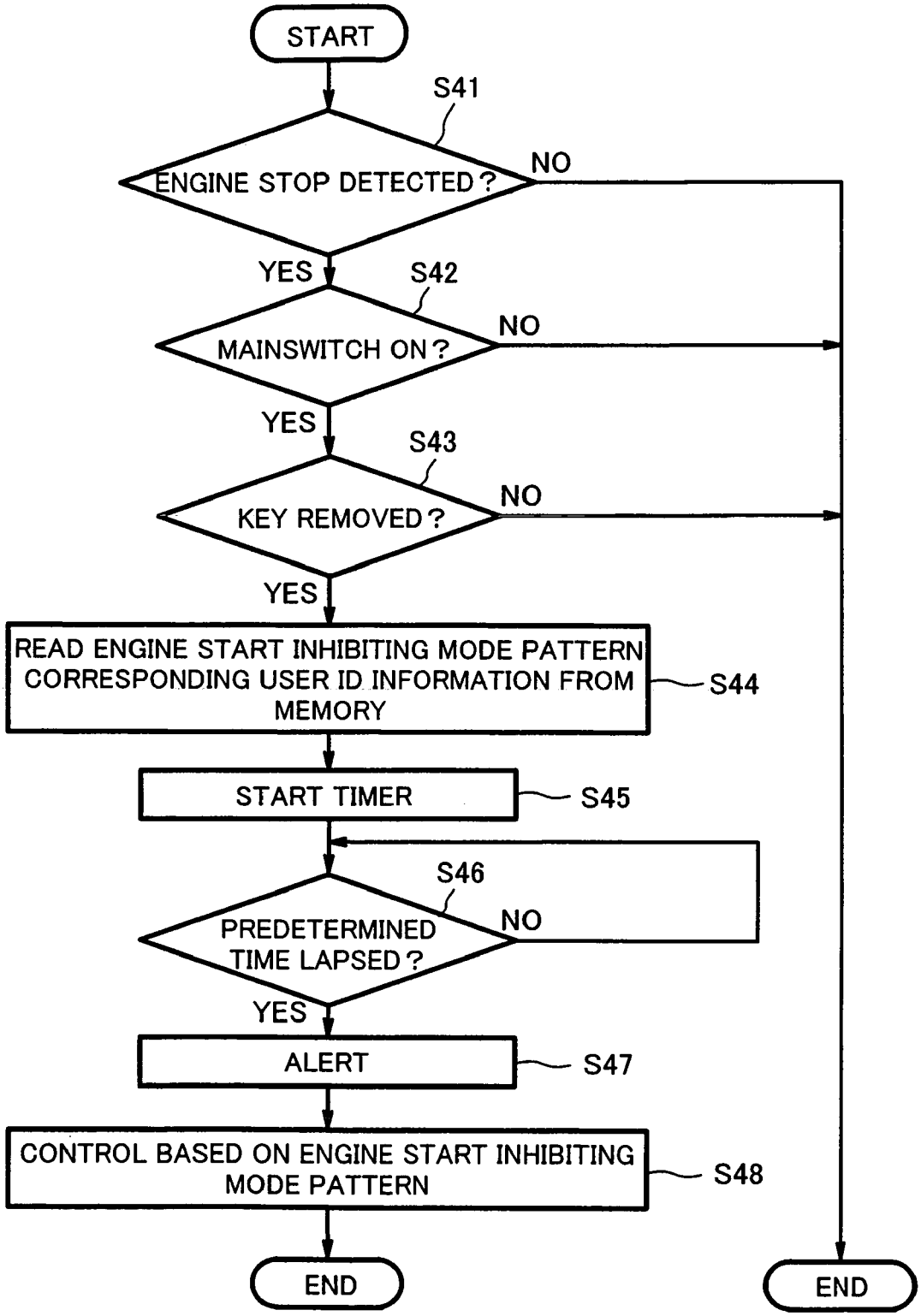
FIG. 9 is a flowchart showing still another control procedure of the ECU of the main switch apparatus shown in FIG. 6.

As still another embodiment is shown in FIG. 9, even after recognizing the removal of the key 40 from the main switch 34 in the ON-state, it is also possible to include a delay function so that it may not transit to the Engine Start Inhibiting Mode immediately.

ECU 50 performs the same steps (that is, Steps S41–S44 in this embodiment) as the Steps S21–S24 in FIG. 7, reads the control pattern for realizing the theft prevention function corresponding to the received user ID information from the control pattern memory 50*a* and, then, starts a time count of the built-in timer 50*h* (see FIG. 6) (Step S45).

In this embodiment, ECU 50 further includes the timer 50*h* and a time lapse detector 50*j* comparing to the previous embodiment. Next, ECU 50 determines by the time lapse detector 50*j* if the time count of the timer 50*h* lapses a predetermined time (for example, several seconds) stored in the built-in memory 50*a* (see FIG. 6) (Step S46). The predetermined time may be different for each user.

If the predetermined time is lapsed ("YES" at Step S46), ECU 50 outputs an alert by the alert controller 50*g* (Step S47). This alert may be, for example, a warning to the user of activation of the theft prevention function after the predetermined time. On the other hand, if the predetermined time is not lapsed ("NO" at Step S46), ECU 50 repeats Step S46.

Then, ECU 50 transitions the engine start inhibitor 50*f* to the "Engine Start Inhibiting Mode" according to the read control pattern (Step S48).

In this configuration, the transition to the Engine Start Inhibiting Mode is delayed by the predetermined time even if a registered user tries starting of the engine E. Therefore, the registered user can start the engine E without the key 40 if the user operates the starter switch 36 within the predetermined time. Of course, even after transitioned to the Engine Start Inhibiting Mode, the user can restart the engine E by inserting the key 40 into the main switch 34, operating the main switch 34 into the OFF-position and, then, again operating to the ON-position.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within the metes and bounds of claims, or equivalence of such metes and bounds thereof are therefore intended to be embraced by claims.

The invention claimed is:

1. A main switch apparatus of a small watercraft comprising:

a main switch connected to a battery of the watercraft, the main switch being configured such that it selectively opens and closes a power supply line of the watercraft, an engine of the watercraft being able to start when the power supply line is closed, the main switch including an antenna which is configured to receive a radio transmission containing user ID information;

a plurality of keys, each for operating the main switch, each having a transponder configured to store user ID information that is individually assigned to each of the keys, the transponder being supplied with power from the battery through the main switch when the corresponding key is applied to the main switch and turns the main switch into an ON-state thereby enabling the transponder to transmit the radio transmission containing the user ID information stored therein;

an ID information detector for detecting the user ID information received by the antenna;

a controller for controlling the small watercraft; and a control pattern memory for storing a plurality of control patterns of the controller, each control pattern corresponding to user ID information assigned to a respective key;

wherein the controller is configured to access the control pattern stored in the control pattern memory corresponding to the user ID information detected by the user ID information detector and to execute a control of the watercraft based on the accessed control pattern.

2. The main switch apparatus of the small watercraft of claim 1, wherein the control pattern includes a control of at least one of an ignition device and a fuel injection device of an engine of the watercraft.

3. The main switch apparatus of the small watercraft of claim 1, wherein the control pattern includes a control in which the information indicative of the control pattern being executed is displayed on an indicator of the watercraft.

4. A main switch apparatus of a small watercraft including a main switch, comprising:

a plurality of keys, each configured to operate the main switch, and each assigned different user ID information;

an ID information detector for detecting the user ID information assigned to one of the plurality of keys applied to the main switch;

a controller for controlling the small watercraft, configured to be activated by each one of the plurality of keys;

a control pattern memory for storing a plurality of control patterns of the controller, each control pattern corresponding to user ID information assigned to a respective key, wherein the controller is configured to access the control pattern stored in the control pattern memory corresponding to the user ID information detected by the user ID information detector and to execute a control of the watercraft based on the accessed control pattern;

an engine stop detector for detecting a stop of an engine of the watercraft;

a main switch ON-state detector for detecting an ON-state of the main switch; and a key removal detector for detecting a removal of the key from the main switch;

wherein the control pattern includes a control in which the engine is made at least unable to be started based on the control pattern corresponding to the user ID information; and wherein the controller is configured to read out the control pattern from the control pattern memory corresponding to the user ID information detected by the user ID information detector and to execute a control of the watercraft based on the read out control pattern when the stop of the engine is detected by the engine stop detector, when the ON-state of the main switch is detected by the main switch ON-state detector, and when the removal of the key from the main switch is detected by the key removal detector.

5. The main switch apparatus of the small watercraft of claim 4, further comprising:

a timer configured to count a predetermined time measured from when the stop of the engine is detected by the engine stop detector, when the ON-state of the main switch ON-state detector is detected by the main switch, and when the removal of the key from the main switch is detected by the key removal detector;

wherein the controller is configured to execute the control of the watercraft based on the read out control pattern after the timer counts the predetermined time.

6. The main switch apparatus of the small watercraft of claim 4, further comprising an alert controller configured to produce an output to an indicator of the watercraft to display information indicative of the control pattern, in which the engine is made at least unable to be started based on the control pattern corresponding to the user ID information detected by the ID information detector.

7. A main switch apparatus of a small watercraft, comprising:

a main switch being operable by a key, the main switch being configured so that when an inserted key is rotated in one direction to an ON-position the main switch is transitioned to an ON-state and when the inserted key is rotated in an opposite direction to an OFF-position the main switch is transitioned to an OFF-state, the key being removable from the main switch both when the main switch is in the ON-position and the OFF-position;

a controller for controlling the small watercraft;

an engine stop detector for detecting a stop of an engine of the watercraft;

a main switch ON-state detector for detecting the ON-state of the main switch; and a key removal detector for detecting a removal of the key from the main switch wherein the controller is configured to inhibit start of the engine when an engine stop is detected by the engine stop detector, and the ON-state of the main switch is detected by the main switch ON-state detector, and the removal of the key from the main switch is detected by the key removal detector.

8. The main switch apparatus of the small watercraft of claim 7, further comprising an alert controller configured to produce an output to an indicator of the watercraft to display information that indicates the start of the engine is inhibited by the controller.

9. A main switch apparatus of a small watercraft, comprising:

a main switch connected to a battery of the watercraft, the main switch including a key hole and being configured such that it selectively opens and closes a power supply line of the watercraft, an engine of the watercraft being startable when the main switch closes the power supply line;

a plurality of keys, each key being configured to operate the main switch, and each key being assigned different user ID information;

an ID information detector for detecting the user ID information assigned to one of the plurality of keys inserted into the key hole of the main switch, wherein the main switch is configured so that when an inserted key is rotated in one direction to an ON-position the main switch is transitioned to an ON-state and when the inserted key is rotated in an opposite direction to an OFF-position the main switch is transitioned to an OFF-state, the key being removable from the main switch both when the main switch is in the ON-position and the OFF-position;

a controller for controlling the small watercraft; and a control pattern memory for storing a plurality of control patterns of the controller, each control pattern corresponding to user ID information assigned to a respective key;

wherein the controller is configured to access the control pattern stored in the control pattern memory corresponding to the user ID information detected by the user ID information detector and to execute a control of the watercraft based on the accessed control pattern.

* * * * *